US010444691B2

(12) United States Patent
Watanabe

(10) Patent No.: US 10,444,691 B2
(45) Date of Patent: Oct. 15, 2019

(54) IMAGE FORMING APPARATUS AND CONTROL PROGRAM

(71) Applicant: Konica Minolta, Inc., Tokyo (JP)

(72) Inventor: Toshifumi Watanabe, Aichi (JP)

(73) Assignee: KONICA MINOLTA, INC., Tokyo (JP)

( * ) Notice: Subject to any disclaimer, the term of this patent is extended or adjusted under 35 U.S.C. 154(b) by 154 days.

(21) Appl. No.: 15/581,721

(22) Filed: Apr. 28, 2017

(65) Prior Publication Data

US 2017/0336745 A1 Nov. 23, 2017

(30) Foreign Application Priority Data

May 17, 2016 (JP) ..... 2016-098588

(51) Int. Cl.
*G03G 15/00* (2006.01)
*G03G 15/06* (2006.01)

(52) U.S. Cl.
CPC ..... *G03G 15/556* (2013.01); *G03G 15/065* (2013.01)

(58) Field of Classification Search
None
See application file for complete search history.

(56) References Cited

U.S. PATENT DOCUMENTS 4,797,705 A * 1/1989 Nishioka ..... G03G 15/02 399/31
9,400,442 B2 * 7/2016 Kaneko ..... G03G 15/5037
2008/0138094 A1 * 6/2008 Shiori ..... G03G 15/065 399/9
2014/0064751 A1 * 3/2014 Kuroiwa ..... G03G 15/55 399/31
2015/0023675 A1 * 1/2015 Matsushita ..... G03G 15/50 399/38
2015/0125184 A1 * 5/2015 Higaki ..... G03G 15/0233 399/176

FOREIGN PATENT DOCUMENTS

JP H11352754 A 12/1999

* cited by examiner

*Primary Examiner* — Roy Y Yi
(74) *Attorney, Agent, or Firm* — Lucas & Mercanti, LLP

(57) ABSTRACT

An image forming apparatus includes: an image carrier that carries and transports a latent image; a charging member that is arranged to be in contact with a surface of the image carrier; a developing device that supplies toner to the image carrier and forms a toner image; a density detection unit that detects a density of the toner image; a pattern detection unit that detects a predetermined density variation pattern based on a detection result of the density detection unit according to the toner image; and a determination unit that determines a state of the charging member based on the number of the predetermined density variation patterns detected within a predetermined period of time.

18 Claims, 11 Drawing Sheets

PORTION AROUND CRACK
CRACK PORTION
4Y
45Y

PHOTORECEPTOR SURFACE CORRESPONDING TO CRACK
3Y

SURFACE POTENTIAL OF PHOTORECEPTOR [V]

POSITION
DENSITY
L*a

POSITION d: PERIMETER OF CHARGING ROLLER

IMAGE FORMING APPARATUS AND CONTROL PROGRAM

The entire disclosure of Japanese Patent Application No. 2016-098588 filed on May 17, 2016 including description, claims, drawings, and abstract are incorporated herein by reference in its entirety.

BACKGROUND OF THE INVENTION

Field of the Invention

The present disclosure relates to an image forming apparatus, and more specifically to an image forming apparatus according to an electrophotographic method.

Description of the Related Art

In an image forming apparatus according to an electrophotographic method, as a means for charging a photoreceptor, a non-contact charging method using corona discharge or the like and a contact charging method using a charging roller or the like are known. In recent years, from a viewpoint of energy saving, the contact charging method is more widely prevalent than the non-contact charging method.

The charging roller used for the contact charging method is arranged to be in contact with the photoreceptor and configured to be driven to rotate according to rotation of the photoreceptor. Therefore, the charging roller repeatedly comes into contact with and moves away from the photoreceptor, so that a stress that is received by a surface layer of the charging roller from the photoreceptor varies. The stress variation affects the surface layer of the charging roller, so that the surface layer gradually degrades, eventually breaks, and crack occurs.

By the way, regarding a technique for detecting a surface condition of the charging roller, JP 11-352754 A discloses a configuration in which reflected light of light incident to the charging roller is received and a surface property (surface roughness) of the charging roller is detected. Further, a technique disclosed in JP 11-352754 A applies an appropriate AC current to the charging roller regardless of a state of the surface property of the charging roller by changing the AC current applied to the charging roller from a charging bias power source according to surface property information of the charging roller.

The technique disclosed in JP 11-352754 A optically detects the surface roughness of the charging roller and performs control so that a charged potential of the photoreceptor is stabilized. However, the technique does not describe about a crack. Further, even if the technique disclosed in JP 11-352754 A is used to detect a crack in the charging roller, there is a problem that it is difficult to discriminate between a change of the surface condition of the charging roller due to dirt, scratch, or the like and a change of the surface condition of the charging roller due to a crack.

SUMMARY OF THE INVENTION

The present disclosure has been made to solve the problem as described above, and an object of the present disclosure in a certain aspect is to provide an image forming apparatus that correctly determines a state of the charging roller by accurately detecting a crack generated in the charging roller and a control program used in the image forming apparatus.

To achieve the abovementioned object, according to an aspect, an image forming apparatus reflecting one aspect of the present invention comprises: an image carrier that carries and transports a latent image; a charging member that is arranged to be in contact with a surface of the image carrier; a developing device that supplies toner to the image carrier and forms a toner image; a density detection unit that detects a density of the toner image; a pattern detection unit that detects a predetermined density variation pattern based on a detection result of the density detection unit according to the toner image; and a determination unit that determines a state of the charging member based on the number of the predetermined density variation patterns detected within a predetermined period of time.

When the number of the predetermined density variation patterns detected within the period of time exceeds a predetermined number, the determination unit preferably determines that the charging member is at end of life.

The toner image is preferably formed to obtain a uniform density image. When the pattern detection unit successively detects a first peak higher than a first density, a second peak lower than the first density, and a third peak higher than the first density in the detection result of the density detection unit according to the toner image, the pattern detection unit preferably detects the density variation as the predetermined density variation pattern.

The first and the third peaks preferably have a peak higher than the first density by a first threshold density or more. The second peak preferably has a peak lower than the first density by a second threshold density or more.

The first density preferably includes an average density in a predetermined period of time when the detection result of the density detection unit is within a predetermined density range in the predetermined period of time.

When a difference between a density of at least one of the first and the third peaks and the first density is greater than or equal to a third threshold density, the pattern detection unit preferably detects the difference as the predetermined density variation pattern.

When an inclination of density variation that forms at least one of the first and the third peaks is greater than or equal to a predetermined value, the pattern detection unit preferably detects the inclination as the predetermined density variation pattern.

The image forming apparatus is preferably configured to be able to switch between a normal mode in which an inputted image is printed and a test mode in which a uniform test image is printed and a state of the charging member is determined. The pattern detection unit preferably detects the predetermined density variation pattern based on a density variation of the test image.

The image forming apparatus preferably forms the test image on the image carrier by controlling a developing bias voltage and a charging bias voltage applied to the charging member so that an absolute value of the developing bias voltage applied to a developer carrier included in the developing device is higher than an absolute value of a surface potential of the image carrier after being charged by the charging member in the test mode.

The image forming apparatus preferably controls a surface speed of the image carrier in the test mode to be slower than a rotation speed of the image carrier in the normal mode.

The image forming apparatus preferably further comprises: an image processing unit that reduces image density unevenness by correcting at least one of a developing bias voltage applied to a developer carrier included in the developing device and a charging bias voltage applied to the charging member based on the detection result of the density detection unit in the normal mode.

The density detection unit is preferably arranged to detect the density of the toner image corresponding to a position within a predetermined distance from an end portion in a main scanning direction of the charging member.

The density detection unit is preferably arranged to detect the density of the toner image corresponding to a region where the image forming apparatus is set to be able to perform printing.

The image forming apparatus preferably further comprises: an intermediate transfer body that receives a toner image formed on the image carrier. The density detection unit preferably detects a density of a toner image formed on either one of the image carrier and the intermediate transfer body.

The image forming apparatus preferably further comprises: a display unit that presents information to a user. When the number of the predetermined density variation patterns detected within the period of time exceeds a predetermined number, a warning is preferably displayed on the display unit.

When the number of the predetermined density variation patterns detected within the period of time exceeds a predetermined number, the determination unit preferably limits a printing operation of the image forming apparatus.

To achieve the abovementioned object, according to an aspect, there is provided a non-transitory recording medium storing a computer readable control program of an image forming apparatus including a charging member that is arranged to be in contact with a surface of an image carrier, and the control program reflecting one aspect of the present invention causes a computer to execute processing comprising the steps of: forming a toner image on the image carrier; detecting a density of the toner image; detecting a predetermined density variation pattern based on the detected density; calculating the number of the predetermined density variation patterns detected within a predetermined period of time; and determining a state of the charging member based on the calculated number of the detected density variation patterns.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1A:
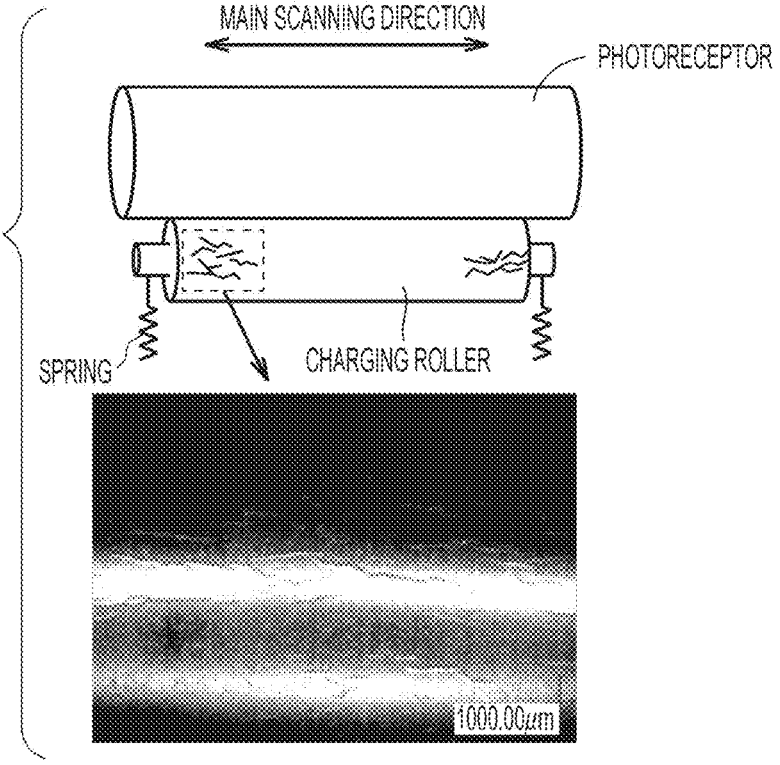
FIGS. 1A to 1C are diagrams for explaining an outline of an image forming apparatus according to an embodiment.

Hereinafter, an embodiment of the present invention will be described in detail with reference to the drawings. However, the scope of the invention is not limited to the illustrated examples. The same or corresponding portions in the drawings are denoted by the same reference numerals and the description thereof will not be repeated.

[A. Outline]

Figure 1B:
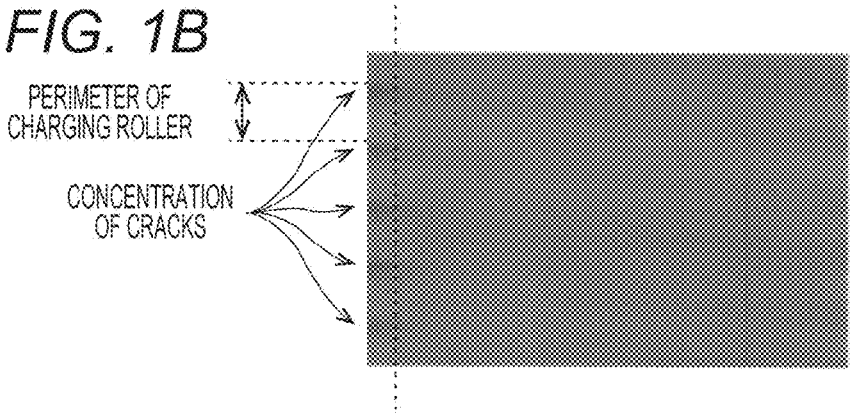
Figure 1C:
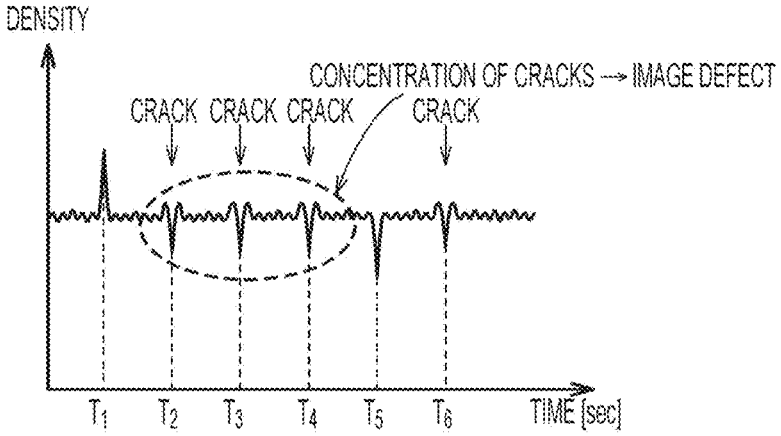

FIGS. 1A to 1C are diagrams for explaining an outline of an image forming apparatus according to the embodiment. Referring to FIG. 1A, a charging roller is arranged to be in contact with a photoreceptor and configured to be driven to rotate according to rotation of the photoreceptor. Therefore, when paying attention to a local region of the charging roller, a stress generated in the local region changes when the local region comes into contact with the photoreceptor and when the local region detaches from the photoreceptor. The variation of the stress is repeated, so that a crack occurs on the surface of the charging roller. Further, surface oxidation of the charging roller due to electric discharge is a factor to accelerate generation of the crack.

In general, both end portions of the charging roller in a main scanning direction are pressed against the photoreceptor by springs, so that variation of the stress at the both end portions is larger than that at a central portion in the main scanning direction. Therefore, many cracks occur in regions near the both end portions in the main scanning direction of the charging roller.

When a crack occurs on the surface of the charging roller, unevenness occurs in the charged potential of the photoreceptor. When unevenness occurs in a surface potential of the photoreceptor, unevenness occurs in the density of tonner developed by the photoreceptor. When small cracks are discretely generated on the surface of the charging roller, human eyes cannot recognize the unevenness of the toner density caused by the cracks. However, when cracks are intensively generated, density unevenness that can be recognized by human eyes occurs, that is, an image defect occurs.

FIG. 1B is an image pattern in a case in which cracks are concentrated on the surface of the charging roller. Referring to FIG. 1B, although an input image is a uniform image, image unevenness caused by cracks of the charging roller is periodically seen at an end portion of the image. The cycle where the image unevenness appears corresponds to the perimeter of the charging roller.

FIG. 1C is a diagram showing a density variation at the position of the dashed line in FIG. 1B. Referring to FIG. 1C, while the image density in a normal portion where no abnormality occurs is stable, a density variation is seen in a portion where some abnormality such as crack, dirt, or scratch occurs on the charging roller with respect to the image density in the normal portion.

The applicant of the present application found a density change pattern corresponding to a crack in the density variation of the image density. The image forming apparatus according to the embodiment specifically detects only a crack in distinction from other abnormalities such as dirt and scratch by detecting a density variation pattern corresponding to a crack from a density waveform corresponding to a uniform image. In an example shown in FIG. 1C, the image forming apparatus according to the embodiment determines that density variations detected at times T2 to T4 and T6 correspond to a crack among density variations detected at times T1 to T6.

Further, the image forming apparatus according to the embodiment counts the number of cracks generated in a predetermined period of time and determines a state of the charging roller based on the number of the generated cracks. More specifically, the image forming apparatus determines that the greater the number of cracks generated in the predetermined period of time, the more the charging roller is degraded. For example, in the example shown in FIG. 1C, three cracks are intensively generated in a period of time between times T2 and T4, so that the image forming apparatus according to the embodiment the charging roller is at end of life.

According to the above description, the image forming apparatus according to the embodiment detects a crack based on a density variation pattern corresponding to the crack from a density waveform of a uniform image, so that the image forming apparatus does not detect a density variation caused by a surface abnormality of the charging roller from other factors such as a scratch and dirt. Therefore, the image forming apparatus according to the embodiment can more accurately detect a crack than ever before.

Further, the image forming apparatus according to the embodiment does not simply determine that the charging roller reaches the end of its life when detecting a crack, but determines the state of the charging roller based on the number of cracks generated in a predetermined period of time. Therefore, the image forming apparatus can correctly determine the state and the end of life of the charging roller. Hereinafter, configuration and control of the image forming apparatus will be described in detail.

[B. Image Forming Apparatus 100]

Figure 2:
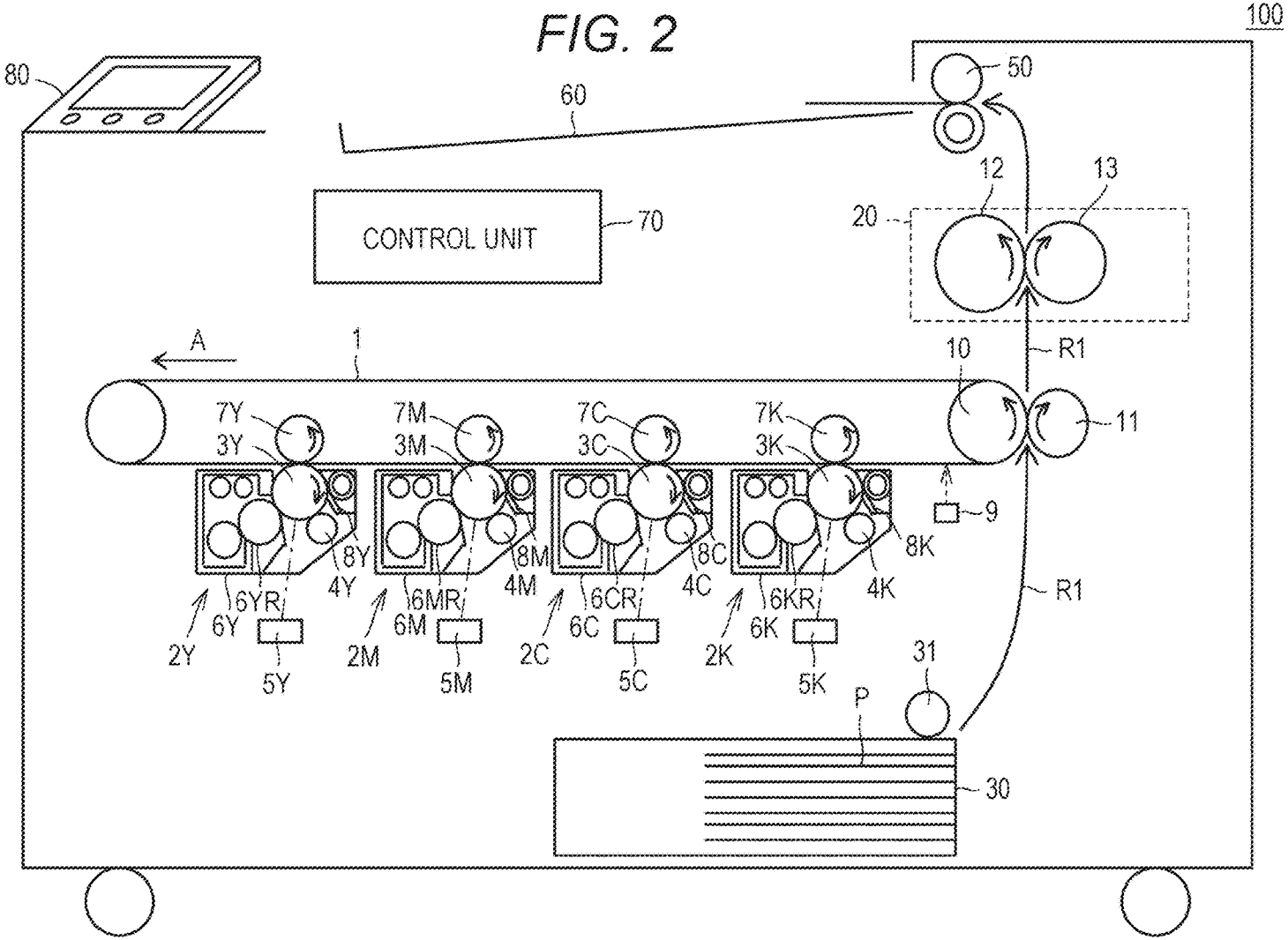
FIG. 2 is a diagram for explaining a configuration example of the image forming apparatus according to the embodiment.

FIG. 2 is a diagram for explaining a configuration example of the image forming apparatus 100 according to the embodiment. The image forming apparatus 100 is an electrophotographic type image forming apparatus such as a laser printer or an LED printer. As shown in FIG. 2, the image forming apparatus 100 includes an intermediate transfer belt 1 as a belt member at an approximately center portion inside the image forming apparatus 100. Under a lower horizontal portion of the intermediate transfer belt 1, four image forming units 2Y, 2M, 2C, and 2K respectively corresponding to colors of yellow (Y), magenta (M), cyan (C), and black (K) are arranged side by side along the intermediate transfer belt 1. The four image forming units 2Y, 2M, 2C, and 2K respectively include photoreceptors 3Y, 3M, 3C, and 3K that are rotatably configured.

Around each of the photoreceptors 3Y, 3M, 3C, and 3K which are image carriers, charging rollers 4Y, 4M, 4C, and 4K, print head units 5Y, 5M, 5C, and 5K, developing devices 6Y, 6M, 6C, and 6K respectively corresponding to developing rollers 6YR, 6MR, 6CR, and 6KR, primary transfer rollers 7Y, 7M, 7C, and 7K respectively facing the photoreceptors 3Y, 3M, 3C, and 3K with the intermediate transfer belt 1 in between, and cleaning blades 8Y, 8M, 8C, and 8K are sequentially arranged along the rotation direction of each of the photoreceptors 3Y, 3M, 3C, and 3K. A density sensor 9 that optically measures the density of toner formed on the intermediate transfer belt 1 is arranged on the downstream side of the image forming unit 2K.

The charging rollers 4Y, 4M, 4C, and 4K are in contact with corresponding photoreceptors 3Y, 3M, 3C, and 3K, respectively, and are driven to rotate according to rotations of corresponding photoreceptors. The developing devices 6Y, 6M, 6C, and 6K are two-component developing devices that use a carrier and a toner as a developer.

A secondary transfer roller 11 is brought into pressure contact with a portion of the intermediate transfer belt 1 supported by an intermediate transfer belt drive roller 10 and a secondary transfer is performed in this region. A fixing device 20 including a fixing roller 12 and a pressure roller 13 is arranged at a downstream position of a transport path R1 behind the secondary transfer region.

A paper feed cassette 30 is attachably/detachably arranged in a lower portion of the image forming apparatus 100. Paper sheets P stacked and housed in the paper feed cassette 30 are fed out one by one from the upper most paper sheet to the transport path R1 by rotation of a paper feed roller 31. A paper discharge tray 60 and a display unit 80 are arranged in an upper portion of the image forming apparatus.

In the present embodiment, as an example, the image forming apparatus 100 employs a tandem type intermediate transfer method. However, the image forming apparatus 100 is not limited to this. Specifically, the image forming apparatus may employ a cycle method of an electrophotographic method or may employ a direct transfer method in which toner is directly transferred from a developing device to a paper sheet.

[C. Schematic Operation of Image Forming Apparatus 100]

Next, A schematic operation of the image forming apparatus 100 having the above configuration will be described. A control unit 70 controls the entire operation of the image forming apparatus 100. When an image signal is inputted from an external apparatus (for example, a personal computer), the control unit 70 generates a digital image signal by color-converting the image signal into yellow, cyan, magenta, and black and causes the print head units 5Y, 5M, 5C, and 5K of the image forming units 2Y, 2M, 2C, and 2K to emit light to perform exposure.

Electrostatic latent images formed thereby on the photoreceptors 3Y, 3M, 3C, and 3K are supplied with toner by the developing rollers 6YR, 6MR, 6CR, and 6KR, so that the electrostatic latent images are developed to toner images of each color. The toner images of each color are sequentially superimposed and primarily transferred onto the intermediate transfer belt 1, which is moving in the arrow A direction in FIG. 2, by actions of the primary transfer rollers 7Y, 7M, 7C, and 7K.

The toner images formed on the intermediate transfer belt 1 in this way are collectively secondarily transferred to the paper sheet P by action of the secondary transfer roller 11. Cleaning blades 8Y, 8M, 8C, and 8K function as cleaning devices that collect toner remaining on the corresponding photoreceptors after the transfer process, so that the cleaning blades 8Y, 8M, 8C, and 8K suppress image unevenness in the next image forming cycle.

The toner image that is secondarily transferred to the paper sheet P reaches fixing device 20. The toner image is fixed to the paper sheet P by the fixing device 20. The paper sheet P to which the toner image is fixed is discharged to the paper discharge tray 60 through a paper discharge roller 50.

The image forming apparatus 100 prints a patch image for adjusting density when adjusting image density and suppresses image unevenness by adjusting the magnitude of a charging bias voltage Vc applied to the charging rollers 4Y, 4M, 4C, and 4K and the magnitude of a developing bias voltage Vd applied to the developing rollers 6YR, 6MR, 6CR, and 6KR based on a measurement result of the patch image measured by the density sensor 9.

[D. Arrangement of Density Sensor 9]

Figure 3:
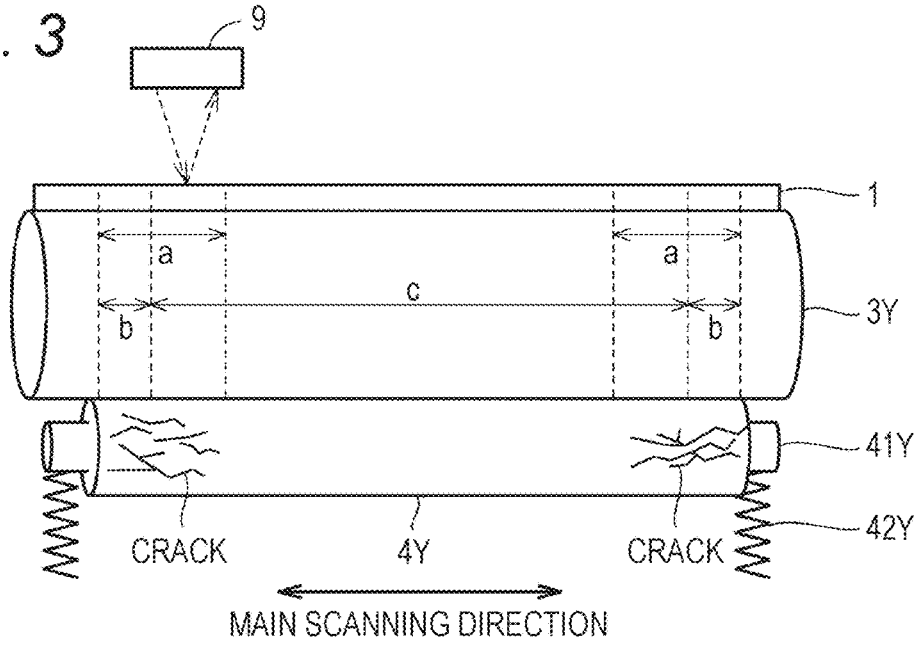
FIG. 3 is a diagram for explaining an arrangement position of a density sensor according to the embodiment.

Next, a measurement position where the density sensor 9 measures the toner density in the main scanning direction of the intermediate transfer belt 1 will be described. FIG. 3 is a diagram for explaining an arrangement position of the density sensor 9 according to the embodiment. In the description below, the yellow image forming unit is used as a typical example. However, the description below is not limited to the yellow image forming unit.

The charging roller 4Y includes a guide member 41Y and springs 42Y. Both end portions in the main scanning direction of the guide member 41Y are pressed against the photoreceptor 3Y by the springs 42Y. Therefore, the pressure of the end portions of the charging roller 4Y is higher than the pressure of the central portion, so that cracks tend to occur in the end portions. The cracks that have occurred in the end portions of the charging roller 4Y gradually extend to the central portion while the charging roller 4Y is used.

The density sensor 9 senses the toner density of a region (indicated by the arrow a in FIG. 3) near the end portion of the charging roller 4Y in order to detect the cracks of the charging roller 4Y in an early stage. It is preferable that the density sensor 9 detects the toner density in a main scanning direction position of the intermediate transfer belt 1. As an example, the density sensor 9 detects the toner density of the intermediate transfer belt 1 corresponding to a region within 30 mm from the end portion in the main scanning direction of the charging roller 4Y.

It is more preferable that the density sensor 9 detects the toner density in a main scanning direction position of the intermediate transfer belt 1 corresponding to a region which is near the end portion of the charging roller 4Y and which is within a region set to be printable by the image forming apparatus 100 (a region indicated by the arrow c in FIG. 3). Referring to FIG. 3, regions very close to the both end portions of the charging roller 4Y in the main scanning direction (regions indicated by the arrows b in FIG. 3) are regions where the image forming apparatus 100 cannot print in principle. Therefore, the image forming apparatus 100 according to the embodiment determines a state of the charging roller 4Y in a use environment of the image forming apparatus 100 by avoiding density measurement in the above regions by the density sensor 9. In the example of FIG. 3, for convenience of description, it looks as if the density sensor 9 measures the toner density of the intermediate transfer belt 1 located immediately above the yellow photoreceptor 3Y. However, actually, the density sensor 9 measures the toner density of the intermediate transfer belt 1 located at a position which is on the downstream side of the image forming unit 2K and which is close to the secondary transfer region (see FIG. 2).

[E. Detection of Crack of Charging Roller]

Figure 4:
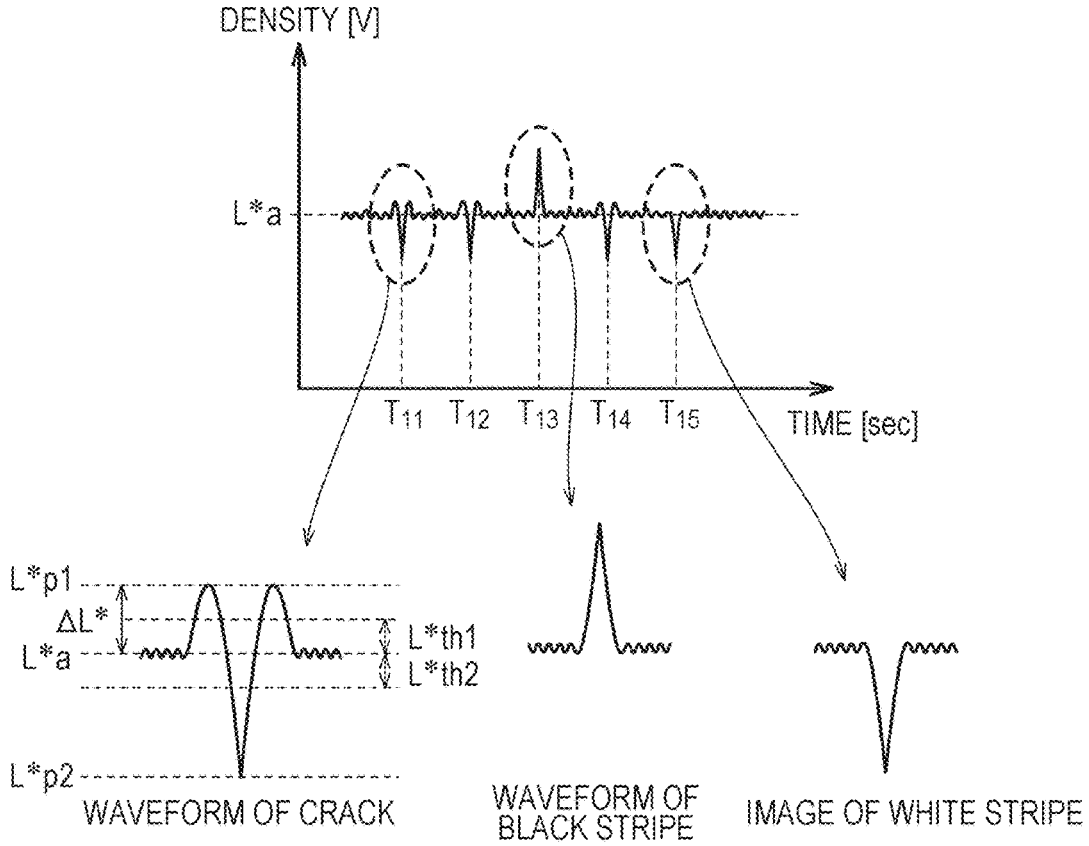
FIG. 4 is a diagram (1) for explaining a density variation pattern corresponding to a crack according to the embodiment.

FIG. 4 is a diagram (1) for explaining a density variation pattern corresponding to a crack according to the embodiment. The vertical axis of FIG. 4 indicates voltage (corresponding to density) detected by the density sensor 9 and the horizontal axis indicates time. In an example shown in FIG. 4, when a uniform image (for example, a halftone image) is printed as a test image, the density sensor 9 detects a density variation in a sub-scanning direction of the test image.

Referring to FIG. 4, the density of the test image corresponding to a normal portion where no abnormality of the charging roller 4Y occurs stabilizes around a reference density L*a. On the other hand, the density of the test image corresponding to a portion where some abnormality such as a crack or a scratch occurs on the charging roller 4Y is away from the reference density L*a. In the example shown in FIG. 4, some abnormality occurs on the charging roller 4Y at times Ill, T12, T13, T14, and T15. The control unit 70 according to the embodiment determines that the density variation patterns corresponding to times T11, T12, and T14 are caused by cracks on the charging roller 4Y. Hereinafter, the reason thereof will be described with reference to FIGS. 5A to 5D.

Figures 5A, 5B, 5C, 5D:
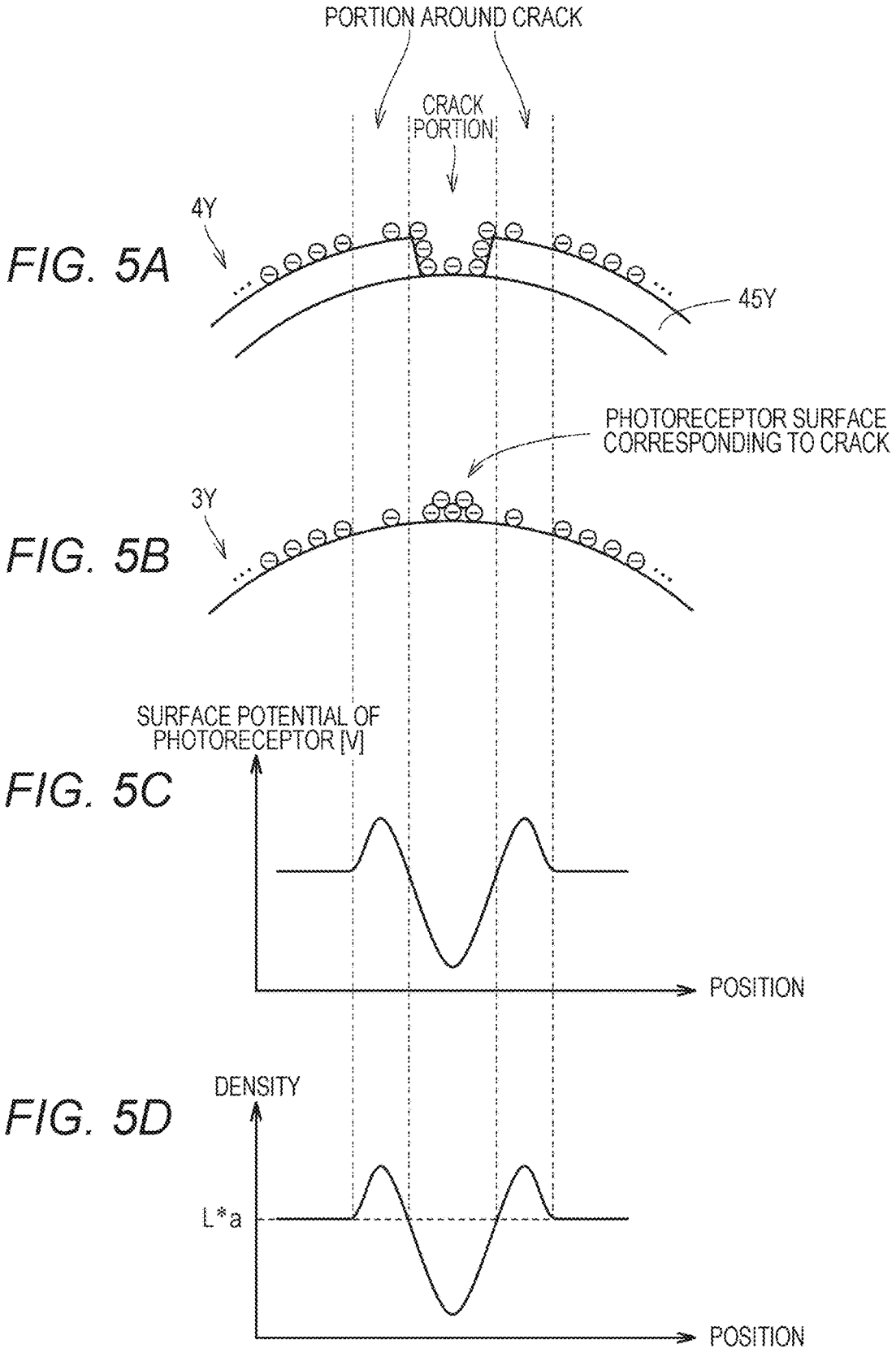
FIGS. 5A to 5D are diagrams (2) for explaining a density variation pattern corresponding to a crack according to the embodiment.

FIGS. 5A to 5D are diagrams (2) for explaining a density variation pattern corresponding to a crack according to the embodiment. Referring to FIG. 5A, a thin protective layer 45Y is formed on the surface of the charging roller 4Y to avoid adhesion of dirt or the like from the outside. The protective layer 45Y is formed of a hard resin or the like. A crack portion of the charging roller 4Y does not have the protective layer 45Y, so that the resistance of the crack portion decreases. Therefore, a charge supply amount to the crack portion is greater than that to a normal portion, so that the surface potential of the crack portion increases. On the other hand, the surface potential of a portion around the crack portion (hereinafter also referred to as a "portion around crack") is lower than that of a normal portion because of the effect that the surface potential of the crack portion rises.

Therefore, as shown in FIGS. 5B and 5C, the surface potential of the photoreceptor 3Y corresponding to the crack portion of the charging roller 4Y decreases and the surface potential of the portion around crack increases. The higher the surface potential of the photoreceptor 3Y, the more the toner tends to attach to the photoreceptor 3Y. Therefore, as shown in FIG. 5D, when a uniform image is printed, the image density of the portion around crack increases and the image density of the crack portion decreases. By using these characteristics, the control unit 70 according to the embodiment identifies the density variation corresponding to the crack. More specifically, when the control unit 70 successively detects a convex portion where the image density is higher than the reference density L*a, a concave portion where the image density is lower than the reference density L*a, and a convex portion, the control unit 70 determines that the density variation pattern corresponds to a crack.

Referring to FIG. 4 again, in the density variation shown at times T11, T12, and T14, a convex portion, a concave portion, and a convex portion appear successively, so that the control unit 70 determines that the density variation is a density variation pattern corresponding to cracks.

The density variation pattern corresponding to the crack is different from a density variation pattern caused by other abnormalities of the charging roller 4Y. For example, when a black stripe image due to a contact failure between the charging roller 4Y and the photoreceptor 3Y is generated, only a convex portion is detected as indicated at time T13. Further, when a white stripe image due to dirt attached to the charging roller 4Y is generated, only a concave portion is detected as indicated at time T15. Therefore, the control unit 70 according to the embodiment can accurately detect only a crack in distinction from other abnormalities such as dirt and scratch by detecting a density variation pattern corresponding to a crack.

As shown in FIG. 4, the density of a normal portion where no abnormality of the charging roller 4Y occurs slightly rises and falls around the reference density L*a. Therefore, a convex portion, a concave portion, and a convex portion may appear successively even in a portion where no crack occurs. Therefore, in another aspect, when the control unit 70 successively detects a convex portion having a peak higher than the reference density L*a by a threshold density L*th1 or more, a concave portion having a peak lower than the reference density L*a by a threshold density L*th2 or more, and a convex portion having a peak higher than the reference density L*a by a threshold density L*th1 or more, the control unit 70 may determine that a density variation pattern corresponding to a crack is detected. According to this configuration, the control unit 70 can ignore a density variation that slightly rises and falls around the reference density L*a, so that the control unit 70 can more accurately detect a crack.

By the way, even when a crack is generated on the surface of the charging roller 4Y, if the crack is small, human eyes cannot recognize density unevenness (image defect) caused by the crack. Therefore, after detecting a density variation pattern corresponding to a crack, the control unit 70 according to the embodiment determines the size of the crack and determines whether or not the detected crack is a crack that affects image defect.

The larger the crack is, the higher the peak density L*p1 of the convex portion and the lower the peak density L*p2 of the concave portion. Therefore, as an example, the control unit 70 according to the embodiment determines that the greater a density difference ΔL between the peak density L*p1 of the convex portion and the reference density L*a, the greater the crack is. When the density difference ΔL is greater than a predetermined threshold density L*th3, the control unit 70 determines that a corresponding crack is a crack that affects image defect. As an example, the threshold density L*th3 is a density corresponding to a lightness index L*=5.0 specified in JIS Z8781-4:2013. In another aspect, the threshold density L*th3 may be set to vary according to a color used by an image forming unit including a charging roller. This is because the density difference that can be recognized by human eyes varies according to color.

In another aspect, the control unit 70 may be configured to determine the size of a crack based on a difference between the peak density L*p1 and the peak density L*p2 or a difference between the reference density L*a and the peak density L*p2.

In further another aspect, when the inclination (differential value) of the density variation that forms the peak density L*p1 is greater than or equal to a predetermined value, the control unit 70 may determine that a corresponding crack is a crack that affects image defect.

In further another aspect, threshold density L*th3 may be set as the threshold density L*th2. According to this configuration, the control unit 70 can detect only a crack that affects image defect.

Figure 6:
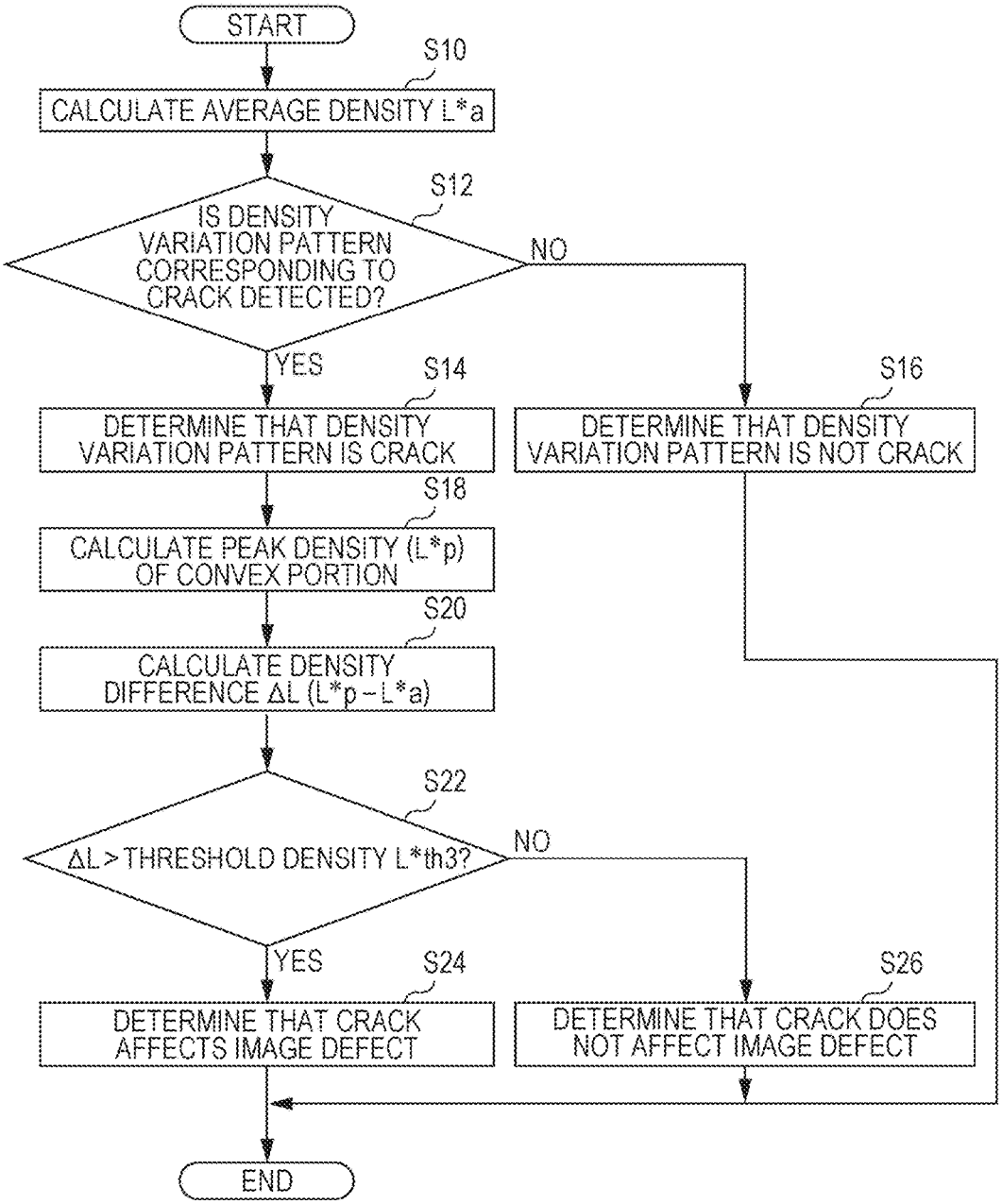
FIG. 6 is a flowchart for explaining a control example for detecting a crack in the image forming apparatus according to the embodiment.

FIG. 6 is a flowchart for explaining a control example for detecting a crack in the image forming apparatus 100 according to the embodiment. The processing shown in FIG. 6 is realized when the control unit 70 executes a control program. In another aspect, some or all of the processing may be executed by a circuit element and other hardware. The conditions described above are the same as those for a flowchart in FIG. 8 described later.

Referring to FIG. 6, in step S10, the control unit 70 calculates the reference density L*a based on a density of a test image (a uniform toner image) measured by the density sensor 9. As an example, when the density of the test image is within a predetermined density range in a predetermined period of time, the control unit 70 calculates an average density in the predetermined period of time as the reference density L*a.

In step S12, the control unit 70 determines whether or not a density variation pattern corresponding to a crack is detected. More specifically, when the control unit 70 successively detects a convex portion having a peak higher than the reference density L*a by a threshold density L*th1 or more, a concave portion having a peak lower than the reference density L*a by a threshold density L*th2 or more, and a convex portion having a peak higher than the reference density L*a by a threshold density L*th1 or more, the control unit 70 determines that a density variation pattern corresponding to cracks is detected. When the control unit 70 determines that a density variation pattern corresponding to a crack is detected (YES in step S12), the control unit 70 advances the processing to step S14 and determines that a crack is detected. On the other hand, when the control unit 70 determines that a density variation pattern corresponding to a crack is not detected (NO in step S12), the control unit 70 advances the processing to step S16 and determines that no crack is detected.

In step S18, the control unit 70 calculates the peak density L*p1 of the convex portion. The convex portion is located at the front and rear of the concave portion, that is, the convex portion is located at two positions. As an example, the control unit 70 calculates the higher of the two peak densities of the two convex portions as the peak density L*p1. In another aspect, the control unit 70 may calculate either one of the two peak densities of the two convex portions as the peak density L*p1.

In step S20, the control unit 70 calculates the density difference ΔL obtained by subtracting the reference density L*a from the peak density L*p1. In step S22, the control unit 70 determines whether or not the calculated density difference ΔL is greater than the threshold density L*th3. When the control unit 70 determines that the density difference ΔL is greater than the threshold density L*th3 (YES in step S22), the control unit 70 advances the processing to step S24 and determines that the crack detected in step S14 is a crack that affects image defect. On the other hand, when the control unit 70 determines that the density difference ΔL is smaller than or equal to the threshold density L*th3 (No in step S22), the control unit 70 advances the processing to step S26 and determines that the detected crack is a crack that does not affect image defect.

According to the above description, the image forming apparatus 100 according to the embodiment determines whether or not there is a crack based on a predetermined density variation pattern, so that it is possible to accurately detect only a crack in distinction from abnormalities of the charging roller caused by other factors. Further, the image forming apparatus 100 can detect a crack generated in the charging roller by using a density sensor for controlling the density, so that it is possible to realize downsizing of the apparatus and suppression of production cost.

[F. Determination of State (End of Life) of Charging Roller]

Figure 7A:
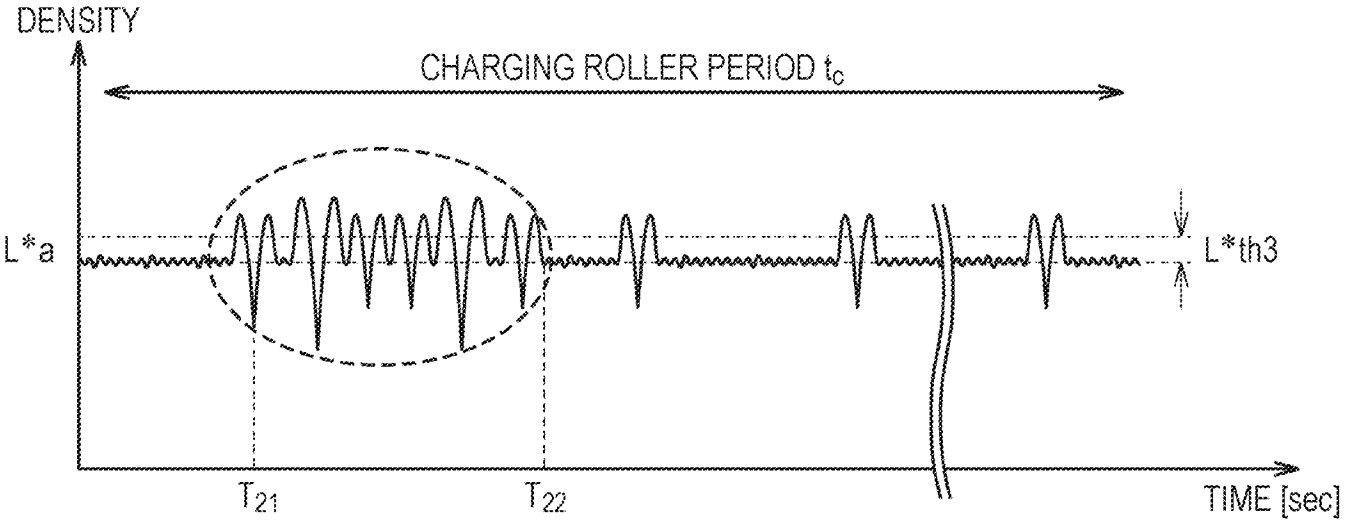
FIGS. 7A and 7B are diagrams for explaining a relationship between cracks and an image defect according to the embodiment.
Figure 7B:
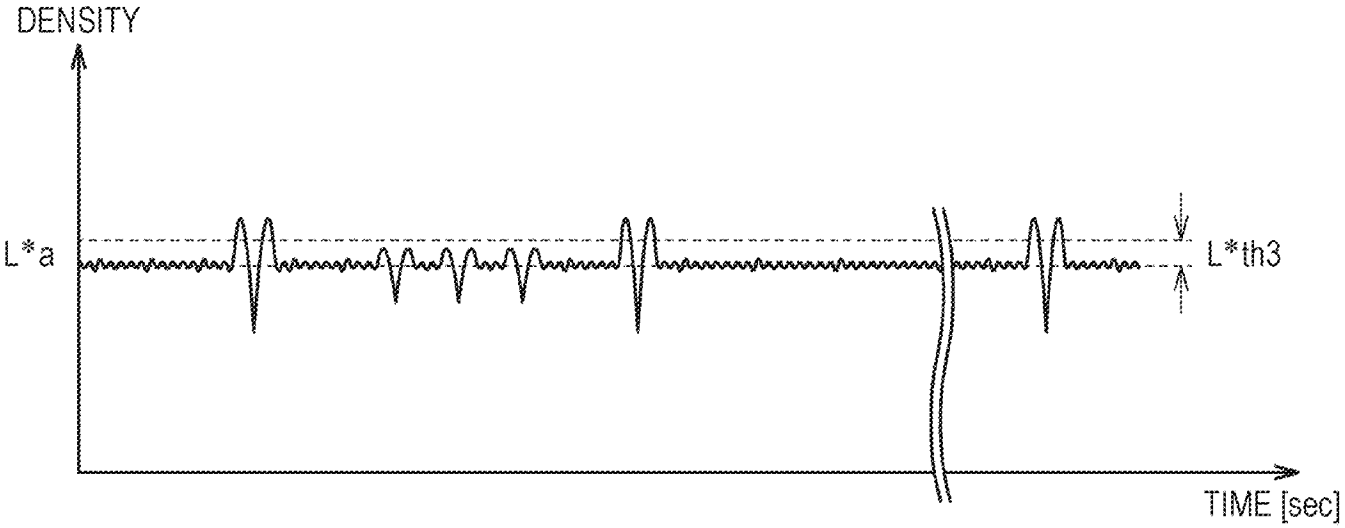

Next, cracks and a state (end of life) of the charging roller 4Y will be described. FIGS. 7A and 7B are diagrams for explaining a relationship between cracks and an image defect according to the embodiment. In the example shown in FIG. 7A, a plurality of density variation patterns corresponding to cracks are detected in a short period of time from time T21 to time T22. Further, the density differences ΔL of the plurality of cracks exceed the threshold density L*th3 and have a magnitude that affect image defect. When large cracks that affect image defect are collectively generated in a local region of the charging roller in this way, human eyes can recognize density unevenness (image defect) caused by the cracks.

On the other hand, even when there are cracks having a magnitude that affect image defect, if the cracks are discretely generated as shown in FIG. 7B, human eyes cannot recognize image defect caused by the cracks.

Because of the above characteristics, the control unit 70 according to the embodiment determines the state of the charging roller 4Y according to the number of density variation patterns, that is, the number of cracks, detected in a predetermined period of time. As an example, the control unit 70 determines that the charging roller 4Y reaches the end of its life when the number of density variation patterns detected in a predetermined period of time is greater than or equal to a threshold value Nth. As an example, the predetermined period of time is a time in which the charging roller 4Y rotates 3 mm. When a surface speed of the charging roller 4Y when the density sensor 9 detects the density of the test image is 100 mm/sec, the predetermined period of time is 30 msec. As an example, the threshold value Nth is 10.

According to the above description, the image forming apparatus 100 according to the embodiment determines whether or not the charging roller 4Y is degraded to a degree to cause an image defect according to the number of cracks per unit length. Therefore, the image forming apparatus 100 can more accurately determine the state (end of life) of the charging roller 4Y than an image forming apparatus that determines the state of the charging roller 4Y based on a single crack.

Figure 8:
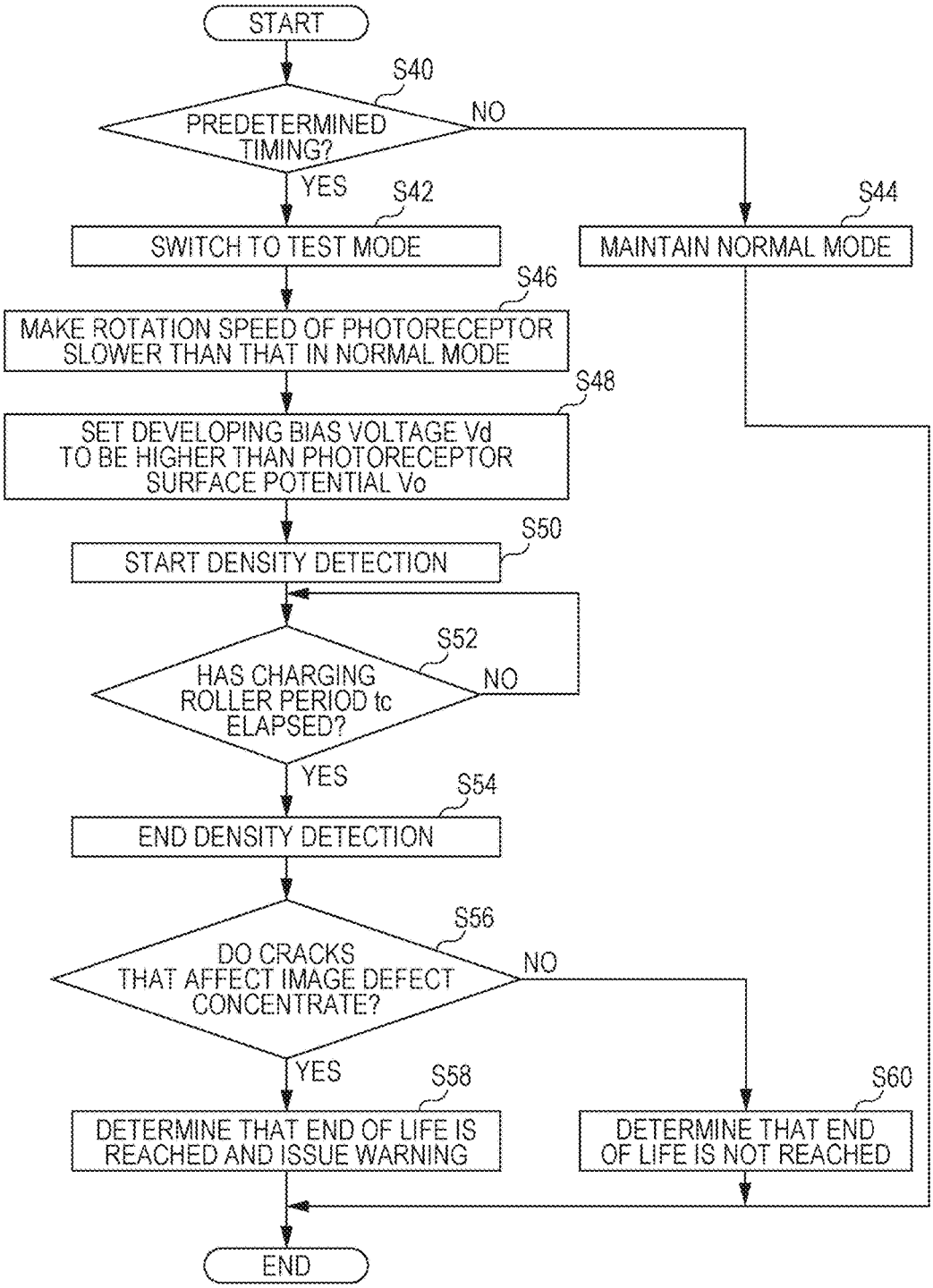
FIG. 8 is a flowchart for explaining a control example that determines a state of a charging roller of the image forming apparatus according to the embodiment.

Next, a control flow for determining the state of the charging roller 4Y will be described with reference to FIG. 8. FIG. 8 is a flowchart for explaining a control example that determines the state of the charging roller 4Y of the image forming apparatus 100 according to the embodiment.

Referring to FIG. 8, in step S40, the control unit 70 determines whether or not it is predetermined timing for determining the state of the charging roller 4Y. The predetermined timing is, for example, a timing when the image forming apparatus 100 is turned on. In another aspect, the predetermined timing may be a timing when the cumulative number of rotations or a cumulative running distance of the charging roller 4Y or the photoreceptor 3Y or the number of paper sheets printed by using the image forming unit 2Y exceeds a predetermined value. In further another aspect, the predetermined timing may be a timing for performing an image stabilization control (for example, a timing when temperature and/or humidity vary to exceed a predetermined value after power-on). The predetermined timing may be a timing obtained by arbitrarily combining the examples described above.

When the control unit 70 determines that it is the predetermined timing (YES in step S40), the control unit 70 advances the processing to step S42 and switches the processing to a test mode for determining the state of the charging roller 4Y. On the other hand, when the control unit 70 determines that it is the predetermined timing (NO in step S40), the control unit 70 advances the processing to step S44 and maintains a normal mode for printing inputted image data.

In steps S46 and S48, the control unit 70 switches to the test mode and sets a condition different from a printing condition of the normal mode. More specifically, in step S46, the control unit 70 sets a surface speed of the photoreceptor 3Y to be slower than that in the normal mode.

When the surface speed of the photoreceptor 3Y, that is, the surface speed of the charging roller 4Y, is too fast, the surface potential of the photoreceptor 3Y is averaged and thereby the toner density acquired by the density sensor 9 is averaged, so that the control unit 70 cannot correctly detect the state of cracks generated in the charging roller 4Y. Therefore, the control unit 70 performs control so that the surface speed of the photoreceptor 3Y in the test mode is slower than that in the normal mode. As an example, the surface speed of the photoreceptor 3Y in the test mode is set to 100 mm/sec. In another aspect, the control unit 70 may be configured to set the surface speed of the photoreceptor 3Y in the test mode to a surface speed of the photoreceptor 3Y when performing printing on a thick paper sheet.

In step S48, the control unit 70 adjusts the developing bias voltage Vd and the charging bias voltage Vc applied to the charging roller 4Y so that an absolute value of the developing bias voltage Vd applied to the developing roller 6YR is higher than an absolute value of the surface potential Vo of the photoreceptor 3Y that has been charged by the charging roller 4Y. Hereinafter, the reason of the above will be described.

Figure 9A:
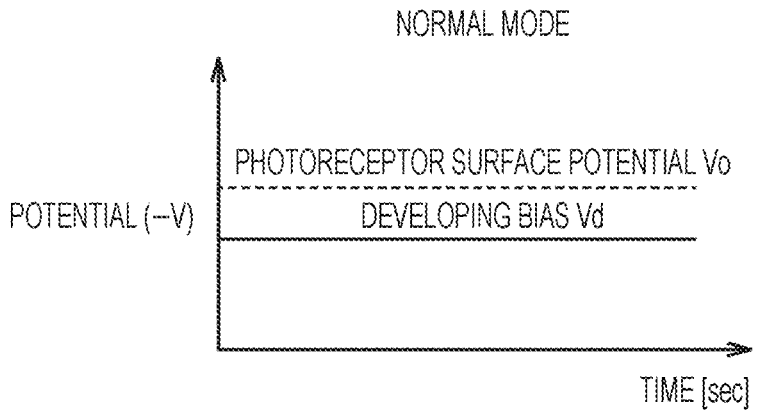
FIGS. 9A and 9B are diagrams for explaining a relationship between a developing bias voltage of a test mode and a surface potential of a photoreceptor that has been charged according to the embodiment.
Figure 9B:
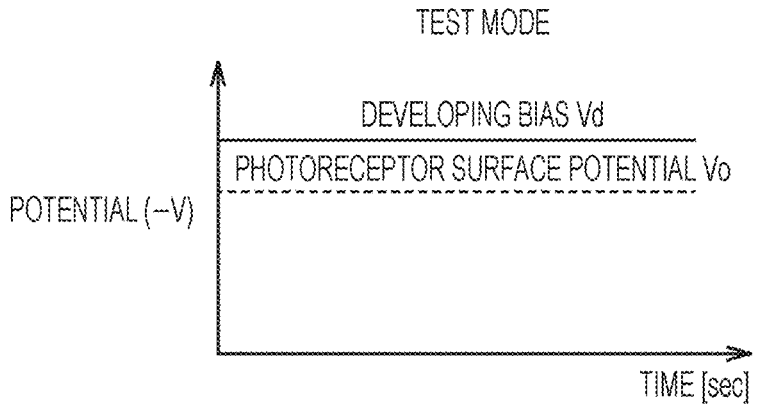

FIGS. 9A and 9B are diagrams for explaining a relationship between the developing bias voltage Vd of the test mode and the surface potential Vo of the photoreceptor 3Y that has been charged according to the embodiment. Referring to FIG. 9A, in the printing condition of the normal mode, the control unit 70 performs setting so that the absolute value of the surface potential Vo of the photoreceptor 3Y that has been charged is higher than the absolute value of the developing bias voltage Vd. Thereby, toner is supplied from the developing roller 6YR to only a portion exposed by the print head unit 5Y on the photoreceptor 3Y and a toner image is formed. If a test image (for example, a halftone image) of an image signal is used in the printing condition, the test image is formed by dots, so that a region to which no toner is attached appears between dots. Therefore, even if a crack is generated in the region to which no toner is attached, the density sensor 9 cannot detect the density variation caused by the crack.

On the other hand, as shown in FIG. 9B, in the test mode, the control unit 70 performs setting so that the absolute value of the developing bias voltage Vd is higher than the absolute value of the surface potential Vo of the photoreceptor 3Y that has been charged. In this condition, toner is uniformly attached to the surface of the photoreceptor 3Y from the developing roller 6YR. Therefore, the density sensor 9 can sensitively detect the density variation caused by a crack. In the test mode, the control unit 70 does not cause the print head unit 5Y to expose the photoreceptor 3Y. Preferably, in the test mode, the control unit 70 performs setting so that the absolute value of the developing bias voltage Vd is higher than the absolute value of the surface potential Vo of the photoreceptor 3Y that has been charged by 100 V or more in order to attach toner to a crack portion where the density is lowest.

Referring to FIG. 8 again, in step S50, the control unit 70 starts density detection of a test image by the density sensor 9. In step S52, the control unit 70 determines whether or not a charging roller period tc has elapsed. The charging roller period tc is a value obtained by dividing the perimeter of the charging roller 4Y by the surface speed of the photoreceptor 3Y in the test mode (that is, the surface speed of the charging roller 4Y that is driven to rotate by the photoreceptor 3Y). The charging roller period tc is stored in a storage device 120 described later. When the control unit 70 determines that the charging roller period tc has elapsed since starting the density detection by the density sensor 9 (YES in step S52), the control unit 70 advances the processing to step S54 and ends the density detection of the test image by the density sensor 9.

In step S56, the control unit 70 determines whether or not cracks that affect image defect are concentrated in the charging roller 4Y. More specifically, the control unit 70 detects the cracks that affect image defect (step S24 in FIG. 6) based on a control flow for detecting cracks shown in FIG. 6 from a result obtained from the density sensor 9. Further, when the number of cracks that affect image defect detected in a predetermined period of time (for example, 30 msec) is greater than or equal to the threshold value Nth (for example, 10), the control unit 70 determines that the cracks that affect image defect are concentrated in the charging roller 4Y.

Figure 10:
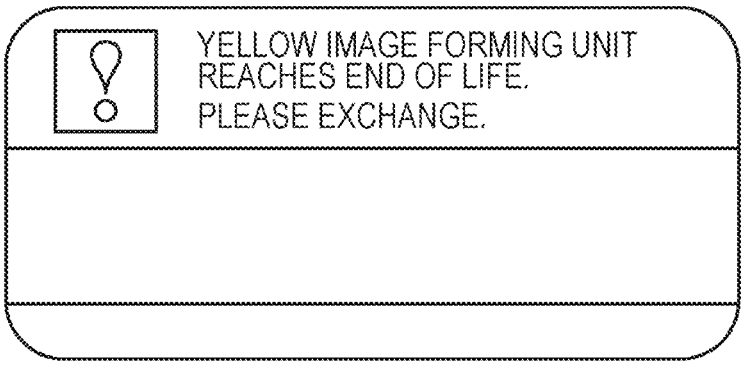
FIG. 10 is a diagram for explaining an example of a warning image according to the embodiment.

When the control unit 70 determines that the cracks that affect image defect are concentrated (YES in step S56), the control unit 70 advances the processing to step S58 and displays an image that warns that the image forming unit 2Y including the charging roller 4Y reaches the end of its life on the display unit 80. FIG. 10 is a diagram for explaining an example of the warning image according to the embodiment.

In another aspect, when the control unit 70 determines that the cracks that affect image defect are concentrated, the control unit 70 may limit the printing operation of the image forming apparatus 100. When cracks are collectively generated in the charging roller 4Y, as described in FIGS. 5B and 5C, the surface potential of the photoreceptor 3Y of a portion corresponding to the cracks lowers, so that carriers tend to attach to the portion. When the carriers attach to the portion, it may cause a dent in the intermediate transfer belt 1 and damage of the fixing device 20. Therefore, the control unit 70 restricts the printing operation of the image forming apparatus 100 during a temporary period until the image forming unit 2Y is replaced. Thereby, the control unit 70 prevents devices other than the image forming unit 2Y from being adversely affected.

In further another aspect, when the control unit 70 determines that the cracks that affect image defect are concentrated, the control unit 70 may inform it to an external apparatus (for example, personal computer) held by a contractor who maintains and manages the image forming apparatus 100. According to this configuration, a service person who knows the end of life of the image forming unit can prepare an image forming unit 2Y and replace the image forming unit.

When the control unit 70 determines that the cracks that affect image defect are not concentrated (NO in step S56), the control unit 70 advances the processing to step S60 and determines that the charging roller 4Y "has not yet reached the end of its life.

In another aspect, the control unit 70, in step S60, may be configured to predict a period of time until the charging roller 4Y reaches the end of its life based on a difference between the threshold value Nth and the number of cracks that affect image defect, which are detected in a predetermined period of time, and displays a prediction result on the display unit 80 or inform the prediction result to an external apparatus held by a contractor who maintains and manages the image forming apparatus 100. In further another aspect, when the predicted period of time until the charging roller 4Y reaches the end of its life is shorter than a predetermined period of time, the control unit 70 may extend the lives of the charging roller 4Y and the image forming unit 2Y by changing the printing condition of the normal mode (for example, setting a high absolute value of the charging bias voltage).

According to a series of controls described above, the image forming apparatus 100 according to the embodiment can accurately detect cracks generated in the charging roller based on a predetermined density variation pattern. Further, the image forming apparatus 100 according to the embodiment can correctly determine the state (the end of life) of the charging roller based on a degree of concentration of the cracks generated in the charging roller. Thereby, it is possible to eliminate an inconvenience that a user or a service person of the image forming apparatus 100 replaces the image forming unit including the charging roller before the charging roller reaches the end of its life.

Figure 11:
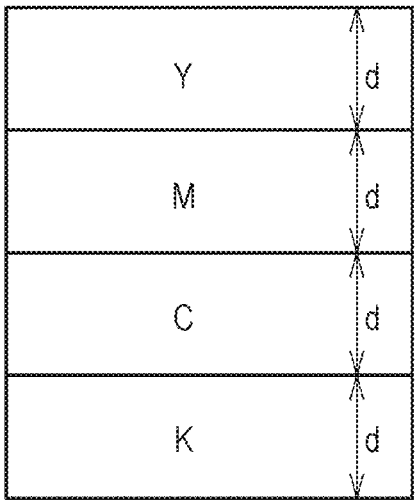
FIG. 11 is a diagram for explaining an example of a test image.

In another aspect, the control unit 70 may determine the state of the charging roller by using a test image as shown in FIG. 11. FIG. 11 is a diagram for explaining an example of the test image. The control unit 70 forms toner images, whose length corresponds to a perimeter d of the charging rollers 4Y, 4M, 4C, and 4K, on the photoreceptors 3Y, 3M, 3C, and 3K, and forms the test image shown in FIG. 11 on the intermediate transfer belt 1. Thereby, the image forming apparatus 100 according to the embodiment can at once determine the states of the charging rollers 4Y, 4M, 4C, and 4K by performing the examination described above.

In the example described above, the density sensor 9 is configured to measure the density of the test image formed on the intermediate transfer belt 1. However, in another aspect, the density sensor 9 may be configured to be arranged to each of the photoreceptors 3Y, 3M, 3C, and 3K and measure the density of the test image formed on each of the photoreceptors.

[G. Control Unit 70]

Figure 12:
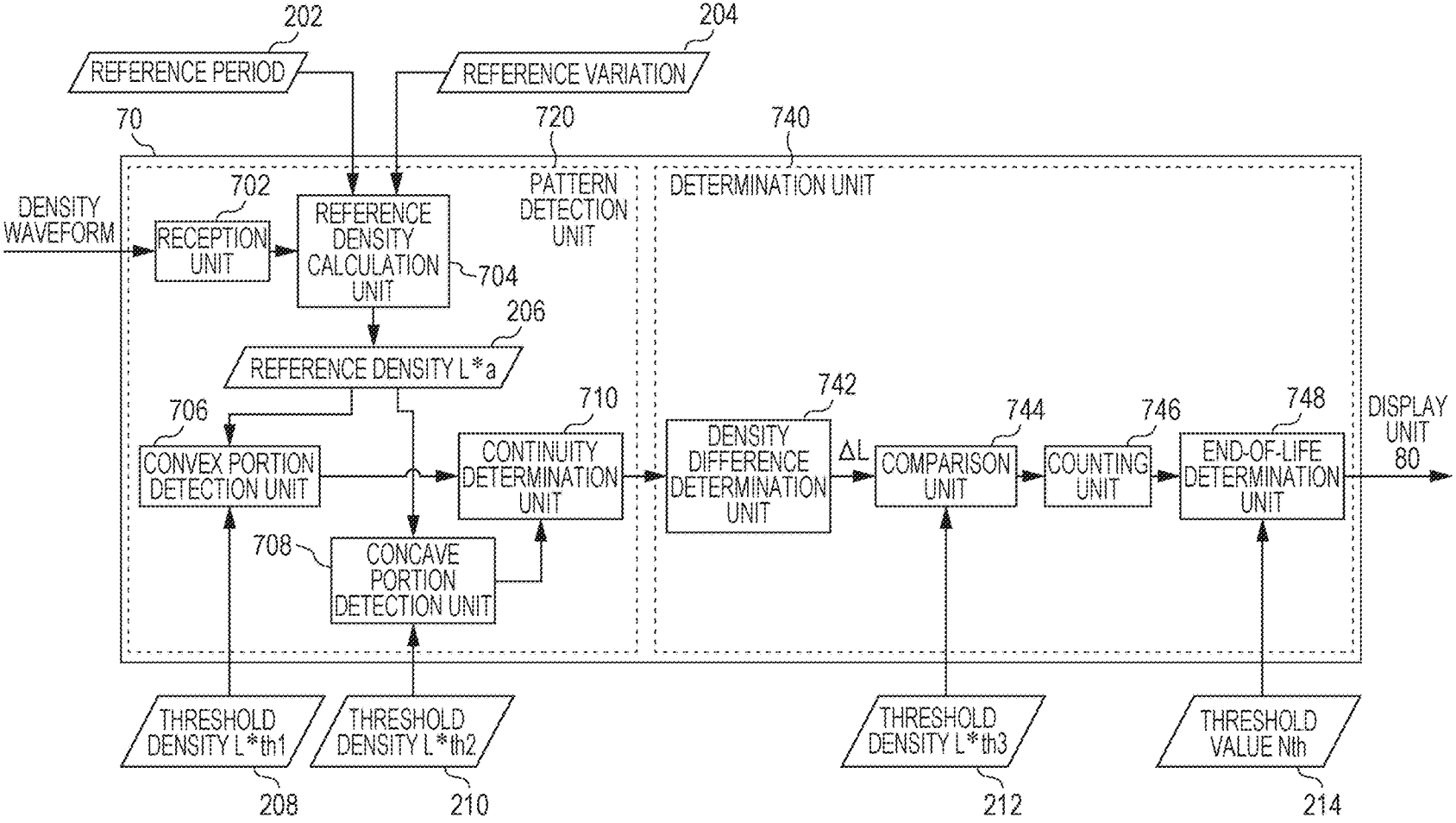
FIG. 12 is a functional block diagram for explaining a functional configuration of a control unit according to the embodiment.

FIG. 12 is a functional block diagram for explaining a functional configuration of the control unit 70 according to the embodiment. Referring to FIG. 12, the control unit 70 has a pattern detection unit 720 and a determination unit 740 as a main functional configuration. The pattern detection unit 720 has a reception unit 702, a reference density calculation unit 704, a convex portion detection unit 706, a concave portion detection unit 708, and a continuity determination unit 710. The determination unit 740 has a density difference determination unit 742, a comparison unit 744, a counting unit 746, and an end-of-life determination unit 748.

The reception unit 702 receives a density waveform of a test image form the density sensor 9 and outputs the density waveform to the reference density calculation unit 704. The reference density calculation unit 704 calculates a reference density L*a 206 based on the inputted density waveform. More specifically, the reference density calculation unit 704 refers to a reference period 202 and a reference variation 204 stored in a storage device 120 described later, detects a region in which the density of the test image is within the reference variation 204 over the reference period 202, calculates the reference density L*a (206) which is an average density of the test image in the region, and outputs the reference density L*a (206) to the convex portion detection unit 706 and the concave portion detection unit 708.

The convex portion detection unit 706 detects a convex portion that has a peak higher than the reference density L*a (206) by a threshold density L*th1 (208) or more. The concave portion detection unit 708 detects a concave portion that has a peak lower than the reference density L*a 206 by a threshold density L*th2 (210) or more. The convex portion detection unit 706 and the concave portion detection unit 708 output the detected convex portion and concave portion to the continuity determination unit 710. The threshold density L*th1 (208), the threshold density L*th2 (210), and a threshold density L*th3 (212) and a threshold value Nth (214) that will be described later are stored in the storage device 120.

The continuity determination unit 710 detects a predetermined density variation pattern corresponding to a crack, where a convex portion, a concave portion, and a convex portion appear continuously, based on information inputted from the convex portion detection unit 706 and the concave portion detection unit 708, and outputs the density variation pattern to the density difference determination unit 742. As an example, when the continuity determination unit 710 detects a convex portion, a concave portion, and a convex portion in this order within a predetermined period of time, the continuity determination unit 710 may determine that the detection result is a predetermined density variation pattern corresponding to a crack. In another aspect, when the continuity determination unit 710 detects a first convex portion, a concave portion, and a second convex portion in this order, if an absolute value of a gradient of density variation between peaks of the first convex portion and the concave portion and an absolute value of a gradient of density variation between peaks of the concave portion and the second convex portion are greater than or equal to a predetermined value, the continuity determination unit 710 may determine that the detection result is a predetermined density variation pattern corresponding to a crack.

Regarding the density variation pattern determined to be a crack by the continuity determination unit 710, the density difference determination unit 742 calculates a density difference ΔL obtained by subtracting the reference density L*a (206) from the peak density L*p1 of the convex portion and outputs the density difference ΔL to the comparison unit 744.

The comparison unit 744 determines whether or not the density difference ΔL is greater than the threshold density L*th3 (212) and when the density difference ΔL is greater than the threshold density L*th3 (212), the comparison unit 744 outputs a signal that informs that the density difference ΔL is greater than the threshold density L*th3 (212) to the counting unit 746. The counting unit 746 counts the number of signals inputted from the comparison unit and outputs a count result to the end-of-life determination unit 748. The counting unit 746 resets a count number held inside the counting unit 746 to zero when outputting the count result to the end-of-life determination unit 748.

When the end-of-life determination unit 748 determines that the count number inputted from the counting unit 746 is greater than or equal to the threshold value Nth (214), the end-of-life determination unit 748 displays a warning image on the display unit 80. The warning image is stored in the storage device 120.

[H. Hardware Configuration of Image Forming Apparatus 100]

Figure 13:
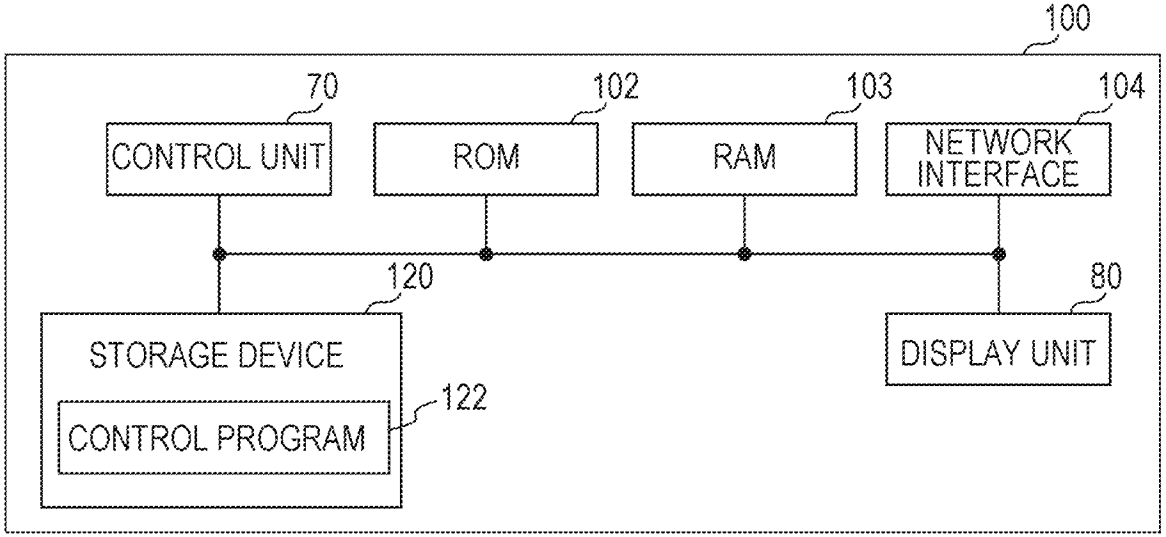
FIG. 13 is a block diagram showing a main hardware configuration of the image forming apparatus.

Next, an example of a hardware configuration of the image forming apparatus 100 will be described with reference to FIG. 13. FIG. 13 is a block diagram showing a main hardware configuration of the image forming apparatus 100.

As shown in FIG. 13, the image forming apparatus 100 includes a control unit 70, a ROM (Read Only Memory) 102, a RAM (Random Access Memory) 103, a network interface 104, the display unit 80, and the storage device 120.

The control unit 70 includes, for example, at least one integrated circuit. The integrated circuit includes, for example, at least one CPU (Central Processing Unit), or at least one ASIC (Application Specific Integrated Circuit), or at least one FPGA (Field Programmable Gate Array), or a combination of these.

The control unit 70 performs control shown in the flowcharts of FIGS. 6 and 8 by executing various programs such as a control program 122 according to the embodiment. The control unit 70 reads the control program 122 from the storage device 120 and stores the control program in the ROM 102 based on reception of an execution instruction of the control program 122. The RAM 103 functions as a working memory and temporarily stores various data necessary to execute the control program 122.

An antenna (not shown in the drawings) and the like are connected to the network interface 104. The image forming apparatus 100 transmits and receives data to and from an external communication device through the antenna. The external communication device is, for example, a server and a mobile communication terminal such as a smartphone. The image forming apparatus 100 may be configured to be able to download the control program 122 from the server through the antenna.

The display unit 80 includes a display and a touch panel. The display and the touch panel are overlapped to each other and the display unit 80 receives a touch operation through the display. The display unit 80 receives, for example, a print operation for the image forming apparatus 100.

The storage device 120 is, for example, a storage medium such as a hard disk or an external storage device. The storage device 120 stores the control program 122 and the like according to the embodiment.

The control program 122 may be provided by being incorporated into part of an arbitrary program instead of being provided as a single program. In this case, control processing according to the embodiment is realized by cooperating with the arbitrary program. Even such a program that does not include some modules is not depart from the scope of the control program 122 according to the embodiment. Further, part or all of the functions provided by the control program 122 may be realized by dedicated hardware. Further, the image forming apparatus 100 may be configured in a form such as a so-called cloud service in which at least one server performs a part of the processing of the control program 122.

Although the present invention has been described and illustrated in detail, it is clearly understood that the same is by way of illustrated and example only and is not to be taken by way of limitation, the scope of the present invention being interpreted by terms of the appended claims. The scope of the present invention includes meanings equivalent to the claims and all modifications within the scope of the claims.

What is claimed is:

1. An image forming apparatus comprising:

an image carrier that carries and transports a latent image;

a charging roller that is arranged to be in contact with a surface of the image carrier;

a developing device that supplies toner to the image carrier and forms a toner image;

a density detection unit that detects a density of the toner image;

a pattern detection unit that detects occurrences of a predetermined density variation pattern based on a detection result of the density detection unit according to the toner image, the predetermined density variation pattern being indicative of a crack in the charging roller; and a determination unit that determines a state of the charging roller based on a number of occurrences of the predetermined density variation patterns detected within a predetermined period of time.

2. The image forming apparatus according to claim 1, wherein when the number of the occurrences of the predetermined density variation patterns detected within the period of time exceeds a predetermined number, the determination unit determines that the charging roller is at end of life.

3. The image forming apparatus according to claim 1, wherein the toner image is formed to obtain a uniform density image, and when the pattern detection unit successively detects a first peak higher than a first density, a second peak lower than the first density, and a third peak higher than the first density in the detection result of the density detection unit according to the toner image, the pattern detection unit detects the density variation as an occurrence of the predetermined density variation pattern.

4. The image forming apparatus according to claim 3, wherein the first and the third peaks have a peak higher than the first density by a first threshold density or more, and the second peak has a peak lower than the first density by a second threshold density or more.

5. The image forming apparatus according to claim 3, wherein the first density includes an average density in a predetermined period of time when the detection result of the density detection unit is within a predetermined density range in the predetermined period of time.

6. The image forming apparatus according to claim 3, wherein when a difference between a density of at least one of the first and the third peaks and the first density is greater than or equal to a third threshold density, the pattern detection unit detects the difference as the occurrences of the predetermined density variation pattern.

7. The image forming apparatus according to claim 3, wherein when an inclination of density variation that forms at least one of the first and the third peaks is greater than or equal to a predetermined value, the pattern detection unit detects the inclination as the occurrence of the predetermined density variation pattern.

8. The image forming apparatus according to claim 1, wherein the image forming apparatus is configured to be able to switch between a normal mode in which an inputted image is printed and a test mode in which a uniform test image is printed and a state of the charging roller is determined, and the pattern detection unit detects the occurrences of the predetermined density variation pattern based on a density variation of the test image.

9. The image forming apparatus according to claim 8, wherein the image forming apparatus forms the test image on the image carrier by controlling a developing bias voltage and a charging bias voltage applied to the charging roller so that an absolute value of the developing bias voltage applied to a developer carrier included in the developing device is higher than an absolute value of a surface potential of the image carrier after being charged by the charging roller in the test mode.

10. The image forming apparatus according to claim 8, wherein the image forming apparatus controls a surface speed of the image carrier in the test mode to be slower than a rotation speed of the image carrier in the normal mode.

11. The image forming apparatus according to claim 8, further comprising:

an image processing unit that reduces image density unevenness by correcting at least one of a developing bias voltage applied to a developer carrier included in the developing device and a charging bias voltage applied to the charging roller based on the detection result of the density detection unit in the normal mode.

12. The image forming apparatus according to claim 1, wherein the density detection unit is arranged to detect the density of the toner image corresponding to a position within a predetermined distance from an end portion in a main scanning direction of the charging roller.

13. The image forming apparatus according to claim 12, wherein the density detection unit is arranged to detect the density of the toner image corresponding to a region where the image forming apparatus is set to be able to perform printing.

14. The image forming apparatus according to claim 1, further comprising:

an intermediate transfer body that receives a toner image formed on the image carrier, wherein the density detection unit detects a density of a toner image formed on either one of the image carrier and the intermediate transfer body.

15. The image forming apparatus according to claim 1, further comprising:

a display unit that presents information to a user, wherein when the number of the occurrences of the predetermined density variation patterns detected within the period of time exceeds a predetermined number, a warning is displayed on the display unit.

16. The image forming apparatus according to claim 1, wherein when the number of the occurrences of the predetermined density variation patterns detected within the period of time exceeds a predetermined number, the determination unit limits a printing operation of the image forming apparatus.

17. A non-transitory recording medium storing a computer readable control program of an image forming apparatus including a charging roller that is arranged to be in contact with a surface of an image carrier, the control program causing a computer to execute processing comprising the steps of:

forming a toner image on the image carrier;

detecting a density of the toner image;

detecting occurrences of a predetermined density variation pattern based on the detected density, the predetermined density variation pattern being indicative of a crack in the charging roller;

calculating a number of occurrences of the predetermined density variation patterns detected within a predetermined period of time; and determining a state of the charging roller based on the calculated number of the detected density variation patterns.

18. The image forming apparatus according to claim 1, wherein for each of the occurrences of the predetermined density variation pattern detected by the detection unit, the determination unit determines whether the predetermined density variation pattern affects an image defect based on a peak density of the each of the occurrences of the predetermined density variation pattern.

* * * * *